US009611759B2

(12) United States Patent
Adaickalasamy et al.

(10) Patent No.: US 9,611,759 B2
(45) Date of Patent: Apr. 4, 2017

(54) APPARATUS AND METHOD FOR ADJUSTING AN INNER CASING OF A TURBOMACHINE

(71) Applicant: General Electric Company, Schenectady, NY (US)

(72) Inventors: James Adaickalasamy, Bangalore (IN); Pramod Akulu, Bangalore (IN); Kenneth Damon Black, Travelers Rest, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 276 days.

(21) Appl. No.: 14/291,070

(22) Filed: May 30, 2014

(65) Prior Publication Data

US 2015/0345336 A1 Dec. 3, 2015

(51) Int. Cl.
*F01D 25/24* (2006.01)
*F01D 25/28* (2006.01)

(52) U.S. Cl.
CPC ..... *F01D 25/28* (2013.01); *F01D 25/24* (2013.01); *F05D 2230/644* (2013.01)

(58) Field of Classification Search
CPC .... F01D 25/28; F01D 25/243; F05D 2230/64; F05D 2230/644
See application file for complete search history.

(56) References Cited

U.S. PATENT DOCUMENTS 4,112,582 A * 9/1978 Beckershoff ..... F01D 25/24 33/655
7,421,783 B2 9/2008 Namburi et al.
7,581,922 B1 * 9/2009 Morimoto ..... F01D 25/285 415/126
2012/0099990 A1 4/2012 Fretwell
2013/0039749 A1 2/2013 Casavant et al.

FOREIGN PATENT DOCUMENTS

EP 2568126 A2 3/2013
WO 2011026516 A1 3/2011

OTHER PUBLICATIONS

European Search Report and Opinion issued in connection with corresponding EP Application No. 15168619.3 on Oct. 21, 2015.

* cited by examiner

*Primary Examiner* — John K Fristoe, Jr.
*Assistant Examiner* — John Hunter
(74) *Attorney, Agent, or Firm* — Dority & Manning, PA

(57) ABSTRACT

A support assembly for externally adjusting an inner casing with respect to an outer casing for a turbomachine includes a carrier plate, a carrier block that is fixedly connected to the carrier plate, a restrictor block fixedly connected to the carrier plate, a rod coupled to the carrier plate, and a plate threadably connected to the rod. The carrier block includes an inclined side and a carrier side. The restrictor block includes a restrictor side and an inclined side. The restrictor side is generally oriented towards the carrier side. A vertical gap for receiving a support arm of an inner turbine casing is defined between the restrictor side and the carrier side. The plate may be rotated about the rod to cause simultaneous movement of the rod, the carrier plate, the carrier block and the restrictor block, thus adjusting the inner casing with respect to the outer casing.

20 Claims, 5 Drawing Sheets

APPARATUS AND METHOD FOR ADJUSTING AN INNER CASING OF A TURBOMACHINE

FIELD OF THE INVENTION

The present invention generally relates to a turbine assembly having an inner turbine casing circumscribed within an outer turbine casing. More particularly, this invention relates to an inner turbine casing support assembly for externally adjusting the inner turbine casing with respect to the outer turbine casing.

BACKGROUND OF THE INVENTION

At least some known industrial turbines, such as gas and/or steam turbines, include an inner turbine casing that is positioned within an outer turbine casing. The inner and outer turbine casings may be split along a horizontal mid-plane such that both the inner and outer turbine casings include an upper half and a lower half, thus allowing for installation and/or removal of a rotor assembly. The inner turbine casing typically surrounds one or more stages of rotatable blades of the rotor assembly and may at least partially define a working fluid flow path through the turbine.

The ability to vertically align the inner turbine casing relative to the outer turbine casing during assembly and/or maintenance of the turbine may be beneficial. For example, clearance gaps that are formed between a tip portion of each of the rotatable blades and an inner surface of the inner turbine casing may be adjusted so as to prevent or reduce leakage of the working fluid through the gaps, thus increasing operating efficiency of the turbine and reducing engine to engine variation. However, adjusting and/or aligning the vertical position of the inner turbine casing with respect to the outer turbine casing during assembly and/or maintenance procedures, particularly when the outer turbine casing is fully assembled around the inner turbine casing, may be time-consuming, difficult, and expensive.

Conventionally, the outer turbine casing must be disassembled in order to gain access to an adjustment system in order to vertically align the inner turbine casing with respect to the outer turbine casing which may result in increased outage and/or assembly time. Therefore, a support assembly which allows for vertical adjustment of the inner turbine casing in situ without removing the outer turbine casing and/or the upper half of the outer turbine casing would be useful.

BRIEF DESCRIPTION OF THE INVENTION

Aspects and advantages of the invention are set forth below in the following description, or may be obvious from the description, or may be learned through practice of the invention.

One embodiment of the present invention is a support assembly for externally adjusting an inner casing with respect to an outer casing of a turbomachine. The support assembly includes a carrier plate and a carrier block that is fixedly connected to one side of the carrier plate. The carrier block includes an inclined side and a carrier side. A restrictor block is fixedly connected to the same side of the carrier plate. The restrictor block includes a restrictor side and an inclined side. The restrictor side is oriented towards the carrier side and a vertical gap is defined therebetween. A rod is coupled to the carrier plate. Means for moving the rod, the carrier plate, the carrier block and the restrictor block is threadably connected to the rod. When rotated, means for moving the rod, the carrier plate, the carrier block and the restrictor block causes the rod, the carrier plate, the carrier block and the restrictor block to move or translate simultaneously in a common direction.

Another embodiment of the present invention is a turbine assembly. The turbine assembly comprises an outer turbine casing. The outer turbine casing includes a lower shelf having an inclined surface and an upper shelf having an inclined surface. The outer turbine casing further includes an aperture that extends through the outer turbine casing between the lower shelf and the upper shelf. An inner turbine casing is at least partially surrounded by the outer turbine casing. The turbine assembly further includes a support assembly for externally adjusting the inner turbine casing relative to the outer turbine casing. The support assembly comprises a carrier plate, a carrier block that is connected to the carrier plate, a restrictor block that is connected to the carrier plate, a rod that is connected to the carrier plate and extends through the aperture of the outer turbine casing, and a plate that is threadably engaged with the rod outside of the outer turbine casing. An inclined side of the carrier block is slideably engaged with the inclined surface of the lower shelf and an inclined side of the restrictor block is slideably engaged with the inclined surface of the upper shelf.

In another embodiment, a method for adjusting an inner turbine casing with respect to an outer turbine casing is provided. The method includes providing an inner turbine casing including a support arm that includes a support surface, providing an outer turbine casing including an aperture that is defined therethrough where the outer turbine casing is radially outward from the inner turbine casing. The outer turbine casing includes a lower shelf having an inclined surface relative to a mid-plane of the outer casing and an upper shelf having an inclined surface relative to a mid-plane of the outer casing. The method further includes rotating a plate that is threadably coupled to a rod of a support assembly to simultaneously move a carrier plate, a carrier block that is slideably engaged with the inclined surface of the lower shelf and a restrictor block that is slideably engaged with the inclined surface of the restrictor block, wherein the support assembly is coupled to the outer casing such that the rod extends through the aperture defined in the outer turbine casing and wherein the carrier block supports the support arm of the inner turbine casing.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
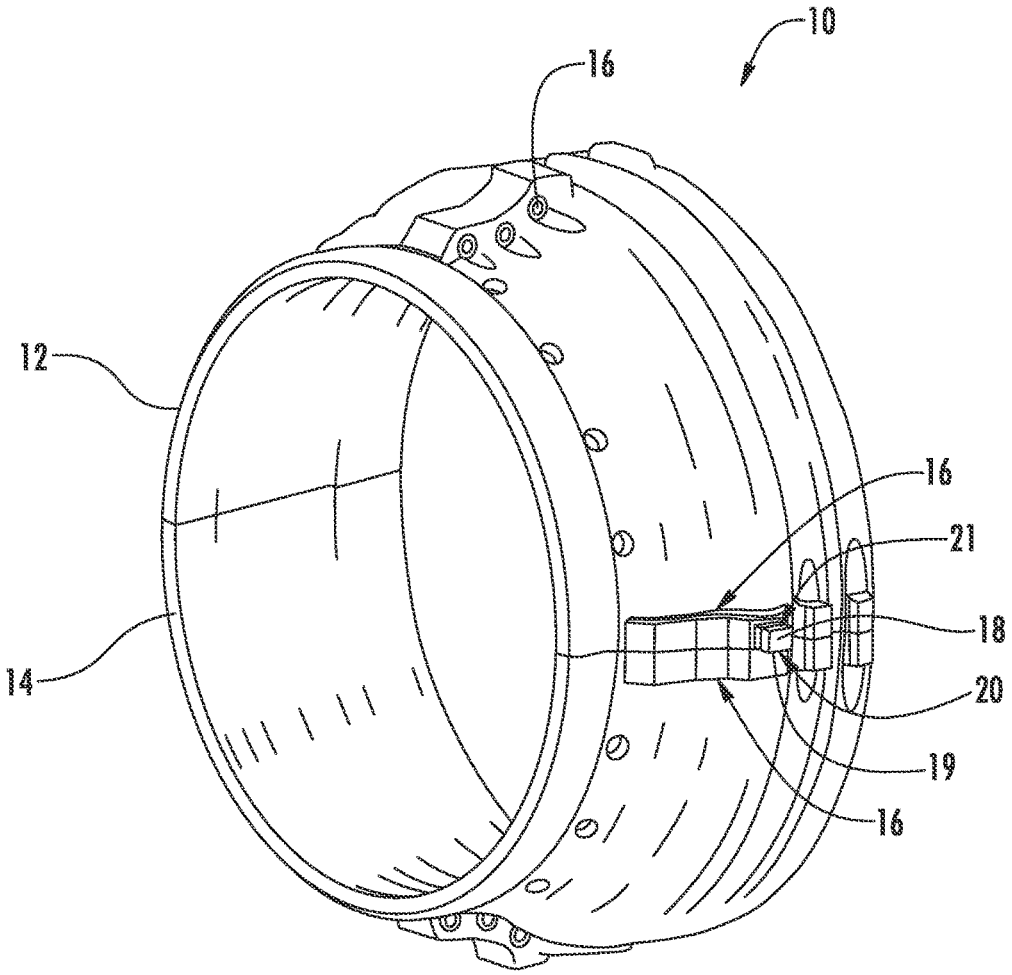
FIG. 1 is a perspective view of an exemplary inner turbine casing.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. For example, although the invention is illustrated and described herein within a turbine, it should be obvious to one of ordinary skill in the art that the invention may be used in any turbomachine such as an axial compressor or any device having an inner casing disposed within an outer casing.

While it is possible to gain access to a rotor assembly and other internal components of a turbine section of a gas turbine by completely disassembling the turbine section, inspections, maintenance and repairs are preferably completed with the rotor and internal components remaining in situ, primarily because of the importance of outage duration which is directly related to the cost of the outage. The apparatus described herein facilitates adjustment of an inner turbine casing assembly with respect to an outer turbine casing. Specifically, an externally adjustable support assembly is provided that facilitates vertical adjustment of the inner turbine casing with respect to an outer turbine casing and alignment of the inner turbine casing with respect to internal components, such as the components of a rotor assembly. In addition, the externally adjustable support assembly restricts upward vertical movement of the inner turbine by simultaneously maintaining a predefined clearance gap between the inner turbine casing and the outer turbine casing as the support assembly adjusts the vertical position of the inner turbine casing. Moreover, the support assembly described herein also facilitates adjusting a turbine casing assembly without requiring an outer turbine casing to be disassembled prior to adjustment. Furthermore, the apparatus described herein facilitates reducing repair and replacement costs associated with turbine adjustment systems.

FIG. 1 is a perspective view of an exemplary inner turbine casing 10. In the exemplary embodiment, inner turbine casing 10 includes an upper half 12 and a lower half 14. Alternatively, inner turbine casing 10 may be unitarily formed. To assemble inner turbine casing 10, bolts (not shown) or any other suitable fasteners are inserted through apertures 16 defined in upper and lower halves 12 and 14. Specifically, the bolts couple upper and lower halves 12 and 14 together. Inner turbine casing 10 includes a plurality of support arms 18 that facilitate adjusting inner turbine casing 10 with respect to an outer turbine casing (not shown in FIG. 1). More specifically, in the exemplary embodiment, inner turbine casing 10 includes two support arms 18. The two support arms 18 may be substantially circumferentially opposed. Alternatively, inner turbine casing 10 may include any number of support arms 18 that enables inner turbine casing 10 to function as described herein.

Each support arm 18 at least partially defines a support surface 19 along a bottom portion 20 of support arm 18. Support arm 18 further includes a top portion 21 that is opposite to bottom portion 20. In an exemplary embodiment, support surface 19 has a substantially horizontal profile. Internal components including but not limited to a rotor assembly (not shown) including a shaft and a plurality of rotor blades, rotates within inner turbine casing 10. In addition, internal components such as stator vanes or nozzles and/or seals or shrouds (not shown) may extend radially inwardly from an inner surface of inner turbine casing 10 towards the rotor assembly. Adjusting inner turbine casing 10, as described in detail below, facilitates reducing clearances between inner turbine casing 10 and the various internal components while restricting vertical travel of the inner turbine casing 10 during operation of the turbine, thus increasing an operating efficiency of the turbine and reducing engine to engine variation.

Figure 2:
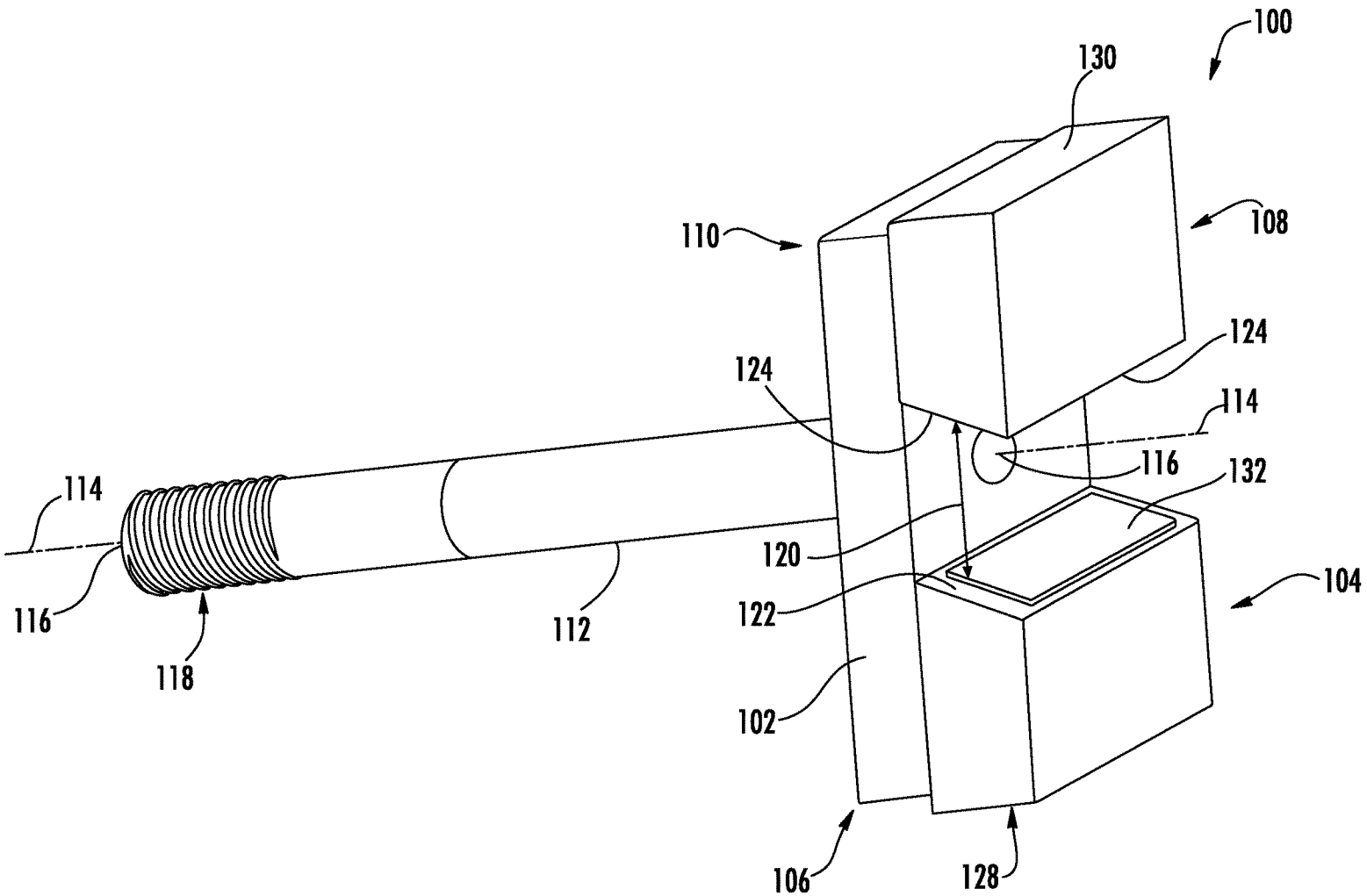
FIG. 2 is a perspective view of an exemplary support assembly that may be used to support the inner turbine casing as shown in FIG. 1, according to at least one embodiment of the present invention.

FIG. 2 is a perspective view of an exemplary support assembly 100 that may be used to adjust inner turbine casing 10 (FIG. 1) with respect to an outer turbine casing (not shown in FIG. 2) while restricting vertical movement of inner casing 10 during operation of the turbine (not shown). In the exemplary embodiment, support assembly 100 includes a carrier plate 102, a carrier block 104 fixedly connected to carrier plate 102 proximate to one end portion 106 of carrier plate 102, a restrictor block 108 fixedly connected to carrier plate 102 proximate to another end portion 110, and a rod 112 for simultaneously moving carrier plate 102, carrier block 104 and restrictor block 108. The carrier block 104 and/or restrictor block 108 may be fixedly connected to carrier plate 102 via bolts or other mechanical fasteners and/or welding or other joining method. In the exemplary embodiment, rod 112 is press-fit and/or doweled into and/or otherwise connected to carrier plate 102 such that rod 112 and carrier plate 102 travel or move together. A longitudinal axis 114 of support assembly 100 extends through a center 116 of rod 112. Rod 112 may include a threaded end 118. In the exemplary embodiment, threaded end 118 of rod 112 is distal from carrier plate 102.

Figure 3:
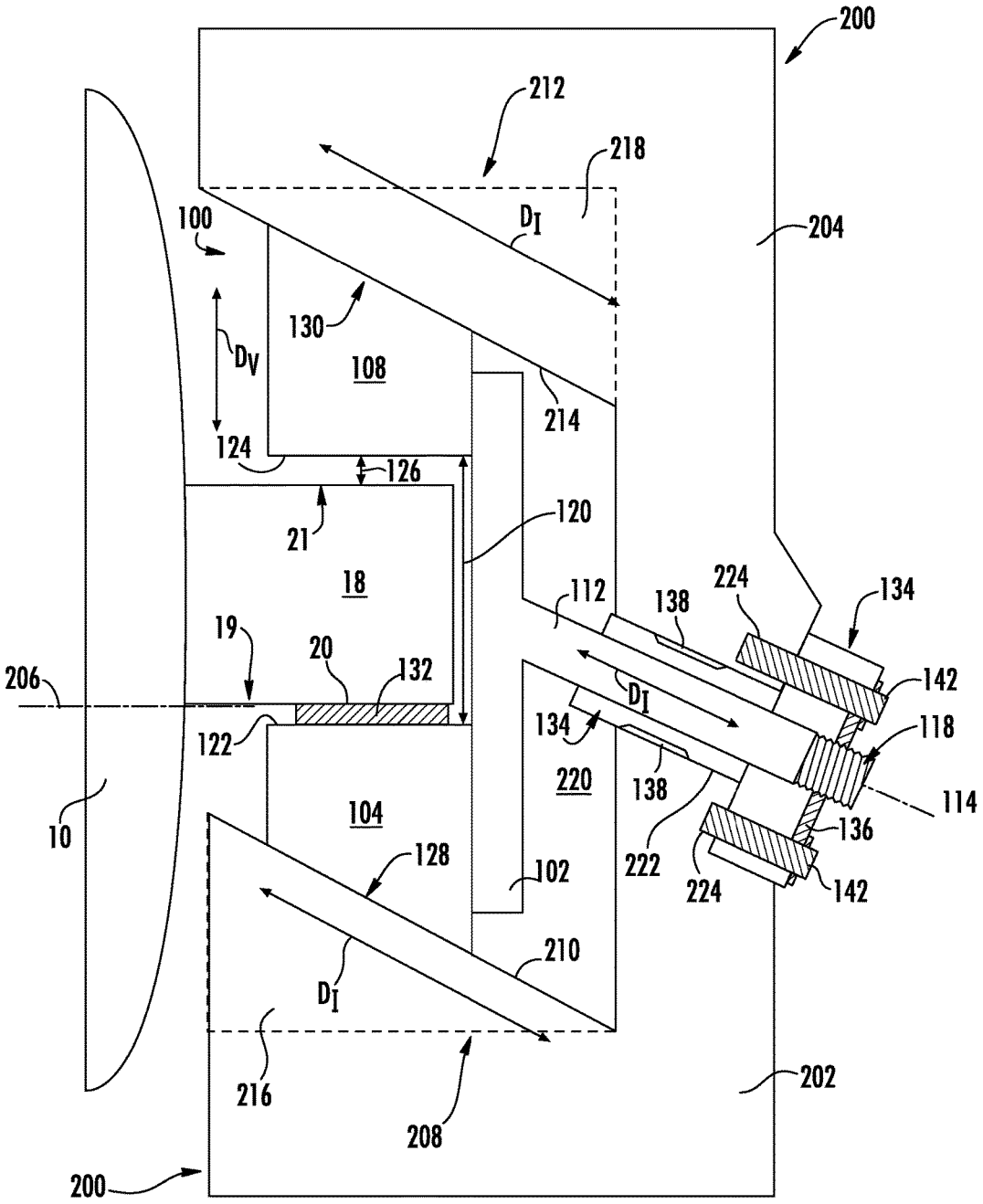
FIG. 3 is a cross sectional side view of a portion of an exemplary turbine assembly including a portion of an outer turbine casing, a portion of the inner turbine casing as shown in FIG. 1 and the support assembly as shown in FIG. 2, according to one or more embodiments of the present invention.

FIG. 3 is a cross sectional side view of support assembly 100 as shown in FIG. 2 installed into a portion of an exemplary outer turbine casing 200 and further including a portion of inner turbine casing 10 and an exemplary support arm 18 according to the exemplary embodiment. As shown in FIGS. 2 and 3, a vertical gap 120 is defined between a carrier side 122 of carrier block 104 and a restrictor side 124 of restrictor block 108. Gap 120 is generally sized to accommodate support arm 18 therebetween.

When support assembly 100 is installed, as shown in FIG. 3, a clearance gap 126 (FIG. 3) is defined between top portion 21 of support arm 18 and restrictor side 124 of restrictor block 108. Clearance gap 126 may be sized to accommodate for thermal growth of inner turbine casing while also restricting vertical movement of the inner turbine casing. In the exemplary embodiment, as shown in FIGS. 2 and 3, carrier block 104 includes an inclined portion 128 and restrictor block 108 includes an inclined portion 130. Carrier side 122 and/or restrictor side 124 may have a profile that is substantially horizontal, arcuate, inclined and/or any other shape or combination of shapes that is complementary to a profile of support surface 19 so as to provide a platform for supporting support arm 18.

In one embodiment, a shim 132 extends at least partially across carrier side 122 of carrier block 104. When used, shim 132 contacts support arm 18 and/or support surface 19 and supports inner turbine casing 10, as described in detail below. Shim 132 may comprise a thin piece of material such as a metallic alloy and/or a coating that forms a wear interface on carrier side 122 of carrier block 104.

Figure 4:
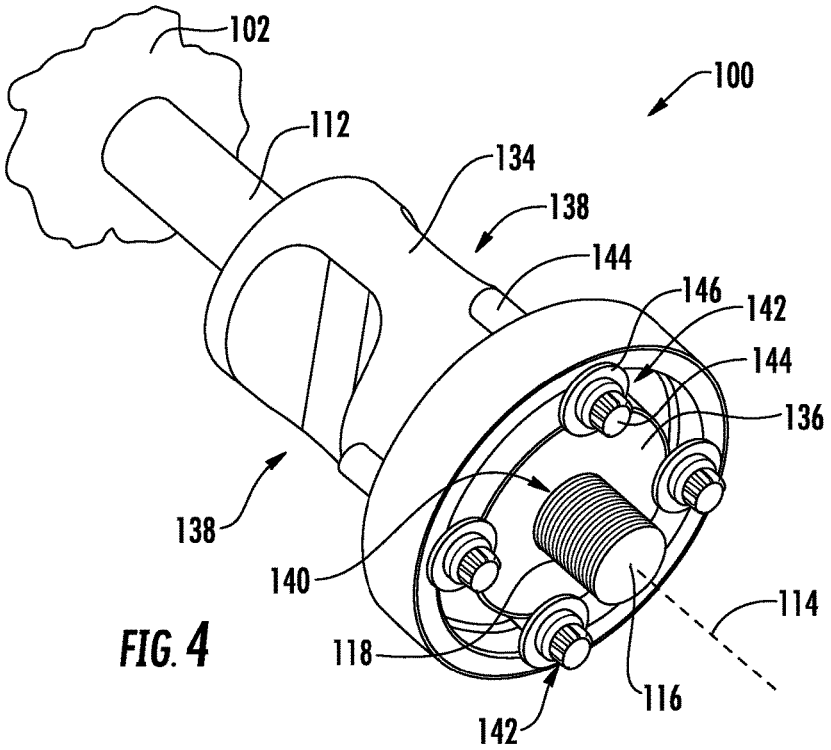
FIG. 4 is a perspective view of a portion of the support assembly including an exemplary bushing for securing the support assembly to the outer turbine casing, according to one embodiment of the present invention.

FIG. 4 is a perspective view of a portion of support assembly 100 that may be used to adjust inner turbine casing 10 with respect to outer turbine casing (FIG. 3). In the exemplary embodiment, support assembly 100 further includes a bushing 134 and means for moving rod 112 along the longitudinal axis 114. In the exemplary embodiment, means for moving rod 112 includes plate or lock plate 136 that is threadably coupled to rod 112 as shown in FIGS. 3 and 4 such that rotation of lock plate 136 about the longitudinal axis 114 results in movement of rod 112 in direction $D_I$. In other embodiments, means for moving rod 112 includes but is not limited to an adjustment nut threadably coupled to rod 112. Bushing 134 is substantially cylindrical and includes at least two recesses 138 defined therein. Recesses 138 enable a rotational position of bushing 134 to be secured with respect to outer turbine casing 200 (FIG. 3). Alternatively, bushing 134 may not include recesses 138.

In the exemplary embodiment, bushing 134 includes a rod aperture 140 defined therethrough. Rod 112 extends through aperture 140 to slideably engage bushing 134. Plate 136 threadably engages threaded end 118 of rod 112. To adjust support assembly 100, plate 136 is rotated about longitudinal axis 114, as described in more detail below. Plate 136 can be rotated using, for example, a spanner wrench and/or any other suitable powered and/or unpowered tool.

Support assembly 100 may further include a plurality of fastening devices 142 that are used to secure support assembly 100 to outer turbine casing (FIG. 3). Moreover, fastening devices 142 may be used to secure plate 136 with respect to bushing 134. In the exemplary embodiment, each fastening device 142 includes a bolt 144 and a washer 146. Alternatively, fastening device 142 may include any other fastening mechanism that enables support assembly 100 to function as described herein.

In particular embodiments, as shown in FIG. 3, outer turbine casing 200 comprises of a lower half casing 202 and an upper half casing 204. Lower half casing 202 and an upper half casing 204 are typically joined along a mid-plane 206 of the outer turbine casing 200. Outer turbine casing 200 at least partially defines a lower shelf 208 having an inclined surface 210 that is inclined with respect to the mid-plane 206 and an upper shelf 212 having an inclined surface 214 that is similarly inclined with respect to mid-plane 206.

In the exemplary embodiment, lower shelf 208 is at least partially defined by lower half casing 202 and upper shelf 212 is at least partially defined by upper half casing 204. In one embodiment, inclined surface 210 is at least partially defined by an inclined wedge block 216 as illustrated with dotted lines in FIG. 3. In one embodiment, inclined surface 214 is at least partially defined by an inclined wedge block 218 as illustrated with dotted lines in FIG. 3. Lower shelf 208 and an upper shelf 212 may at least partially define a pocket 220 therebetween for receiving support arm 18 and/or support assembly 100.

Inclined side 128 of carrier block 104 is slideably engaged with lower shelf 208. In exemplary embodiment, lower shelf 208 is inclined at an angle that is complementary or coplanar to inclined side 128. Carrier side 122 of carrier block 104 and/or shim 132 is slideably engaged with support arm 18. Inclined side 130 of restrictor block 108 is slideably engaged with upper shelf 212. In addition, upper shelf 212 is inclined at an angle that is complementary or coplanar to inclined side 130.

Outer turbine casing 200 further includes at least one aperture 222 defined therethrough. Each aperture 222 is sized and oriented to receive at least a portion of support assembly 100 therein. A rotational position of bushing 134 is secured with respect to outer turbine casing 200. In the exemplary embodiment, bushing 134 is a separate component from outer turbine casing 200. Alternatively, bushing 134 may be formed integrally with outer turbine casing 200. To secure support assembly 100 to outer turbine casing 200, fastening devices 142 are inserted through bushing 134 and into fastening apertures 224 defined within outer turbine casing 200. Further, when fastening devices 142 are secured in place, plate 136 is secured with respect to bushing 134 along longitudinal axis 114.

Figure 5:
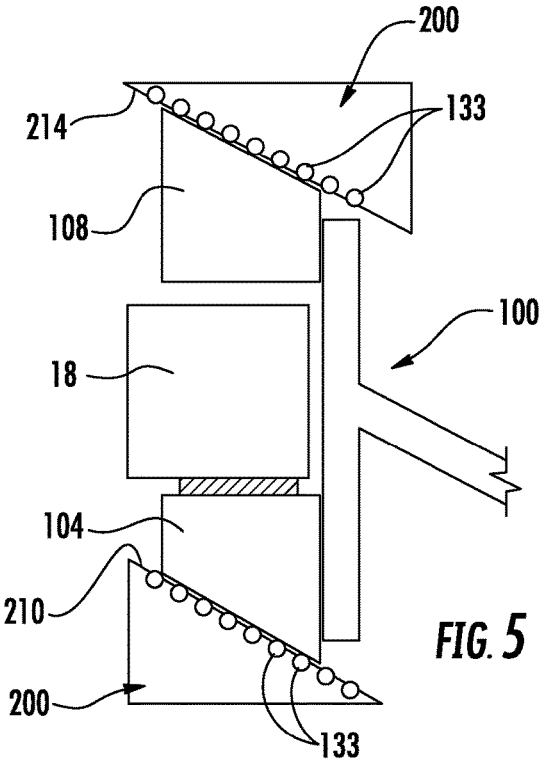
FIG. 5 is a cross sectional side view of a portion of an exemplary turbine assembly including a portion of an outer turbine casing, a support member of the inner turbine casing as shown in FIG. 1, and the support assembly as shown in FIG. 2, according to one or more embodiments of the present invention.

FIG. 5 is a cross sectional side view of a portion of support assembly 100 as shown in FIG. 2 installed into a portion of the exemplary outer turbine casing 200 as shown in FIG. 3, according to one embodiment of the present invention. As shown in FIG. 5, one or more bearings 133 may be provided to facilitate relative movement between support assembly 100 and outer turbine casing 200. Bearings 133 may be disposed or positioned between carrier block 104 and inclined surface 210 and/or between restrictor block 108 and inclined surface 214. Bearings 133 may comprise roller bearings, journal bearings or any bearing known in the art suitable for carrying out the invention as described herein.

To adjust vertical position of inner turbine casing 10 via support assembly 100, plate 136 is rotated about longitudinal axis 114. Plate 136 can be rotated using, for example, a spanner wrench and/or any other suitable powered and/or unpowered tool. Because fastening devices 142 secure plate 136 in position with respect to bushing 134 along longitudinal axis 114, when plate 136 is rotated, plate 136 does not move in direction $D_I$. Rather, because plate 136 is threadably coupled with rod 112, when plate 136 is rotated, rod 112, carrier plate 102, carrier block 104 and restrictor block 108 are moved simultaneously in direction $D_I$, thus moving carrier plate 102, carrier block 104 and restrictor block 108 in vertical direction $D_V$.

More specifically, as plate 136 is rotated, rod 112 slides in direction $D_I$ with respect to bushing 134. As such, when plate 136 is rotated in a first direction, inclined portion 128 of carrier block 104 slideably engages inclined surface 210 of lower shelf 208 and travels in direction $D_I$, thus rising or elevating support arm 18 and/or inner turbine casing 10 in vertical direction $D_V$ with respect to outer turbine casing 200. When plate 136 is rotated in a second direction that is opposite to the first direction, inclined portion 128 of carrier block 104 slideably engages with inclined surface 210 of lower shelf 208 and travels in direction $D_I$, thus lowering support arm 18 and/or inner turbine casing 10 in vertical direction $D_V$ with respect to outer turbine casing 200. Because restrictor block 108 travels with carrier plate 102 and carrier block 104, clearance gap 126 remains substantially constant.

Figure 6:
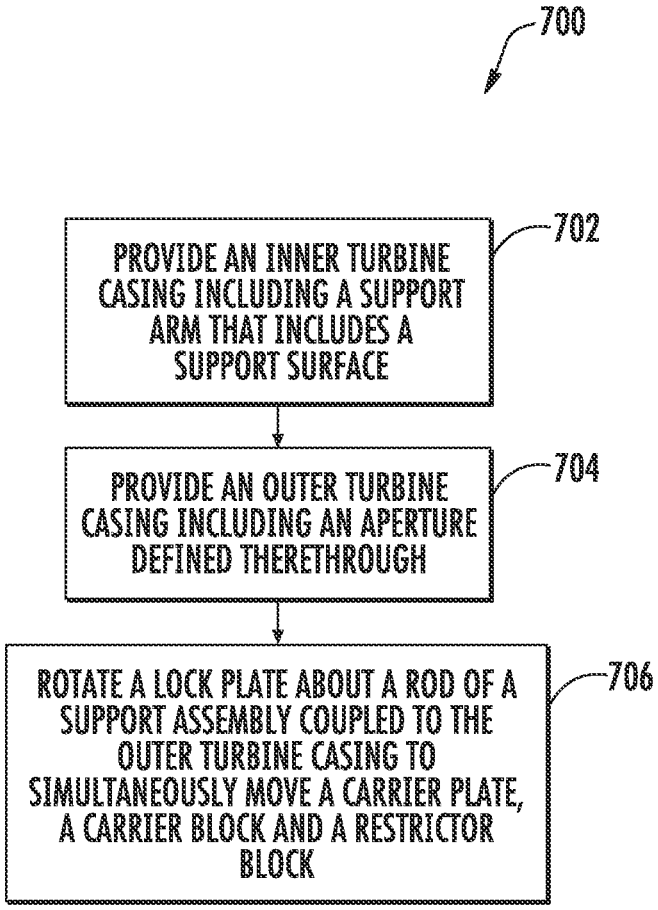
FIG. 6 is a flow chart of an exemplary method for adjusting the inner turbine casing with respect to the outer turbine casing according to one embodiment of the present invention.

FIG. 6 is a flow chart of an exemplary method 700 that may be used for adjusting inner turbine casing 10 with respect to outer turbine casing 200 during assembly and/or maintenance of the turbine. At step 702, method 700 includes providing inner turbine casing 10 with support arm 18 and support surface 19. At step 704, method 700 includes providing outer turbine casing 200 including aperture 222 defined therethrough. Outer turbine casing 200 is radially outward from inner turbine casing 10.

Outer turbine casing 200 includes lower shelf 208 having an inclined surface 210 relative to mid-plane 206 of outer turbine casing 200 and upper shelf 212 having inclined surface 214 relative to mid-plane 206 of outer turbine casing 200. At step 706, method 700 includes rotating plate 136 about rod 112 of support assembly 100 to simultaneously move carrier plate 102, carrier block 104 and restrictor block 108 where carrier block 104 is slideably engaged with inclined surface 210 of lower shelf 208 and restrictor block 108 is slideably engaged with inclined surface 214 of upper shelf 212. Support assembly 100 is coupled to outer casing 200 such that rod 112 extends through aperture 222 defined in the outer turbine casing 200 and carrier block 104 supports support arm 18 of inner turbine casing 10.

The support assembly and method described herein and illustrated in FIGS. 2-6 provide various technical benefits when compared to known adjustment systems. Notably, the support assembly described herein can be adjusted externally from an outer turbine casing such that the outer turbine casing does not need to be disassembled to adjust a vertical position of an inner turbine casing with respect to the outer turbine casing. In addition, only one adjustment is necessary to maintain a clearance gap at a constant dimension, decreasing the time and effort necessary to adjust an inner turbine casing with respect to an outer turbine casing when the inner turbine casing is in situ within the outer turbine casing. Further, as compared to known adjustment systems, the support assembly described herein enables the inner turbine casing to be adjusted relative to the outer turbine casing to be aligned relative to internal components without disassembly. Moreover, because the carrier block and the restrictor block travel together with a single adjustment of the rod, a clearance gap may be maintained without requiring additional adjustments, thus maintaining clearance gap integrity and reducing adjustment time.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal language of the claims.

What is claimed is:

1. A support assembly for externally adjusting an inner casing with respect to an outer casing for a turbomachine, comprising:

a carrier plate;

a carrier block fixedly connected to the carrier plate, the carrier block having an inclined side and a carrier side;

a restrictor block fixedly connected to the carrier plate, the restrictor block having a restrictor side and an inclined side, wherein the restrictor side is oriented towards the carrier side and a vertical gap is defined therebetween;

a rod coupled to the carrier plate; and means for moving the rod, the carrier plate, the carrier block and the restrictor block threadably connected to the rod.

2. The support assembly as in claim 1, wherein means for moving the rod, the carrier plate, the carrier block and the restrictor block comprises a lock plate threadably coupled to the rod.

3. The support assembly as in claim 1, wherein the carrier side of the carrier block is configured to support a support arm of the inner turbine.

4. The support assembly as in claim 1, further comprising a bushing for coupling the support assembly to the outer turbine casing, wherein the rod extends through the bushing and the rod is slideably coupled to the bushing.

5. The support assembly as in claim 4, wherein the rod is configured to slide with respect to the bushing.

6. The support assembly as in claim 1, further comprising a wear surface defined along at least a portion of the carrier side.

7. The support assembly as in claim 6, wherein the wear surface is defined by at least one of a shim and a coating disposed along at least a portion of the carrier side.

8. The support assembly as in claim 1, wherein a longitudinal axis of the rod extends substantially parallel to the inclined side of the carrier block and the inclined side of the restrictor block.

9. A turbine assembly, comprising:

an outer turbine casing, the outer turbine casing including a lower shelf having an inclined surface and an upper shelf having an inclined surface disposed along an inner surface of the outer turbine casing, the outer turbine casing further including an aperture extending through the outer casing between the lower shelf and the upper shelf;

an inner turbine casing at least partially surrounded by the outer turbine casing;

a support assembly for externally adjusting the inner turbine casing relative to the outer turbine casing, the support assembly including a carrier plate, a carrier block connected to the carrier plate, a restrictor block connected to the carrier plate, a rod connected to the carrier plate, the rod extending through the aperture of the outer turbine casing, and a lock plate threadably engaged with the rod outside of the outer turbine casing; and wherein an inclined side of the carrier block is slideably engaged with the inclined surface of the lower shelf and an inclined side of the restrictor block is slideably engaged with the inclined surface of the upper shelf.

10. The turbine assembly as in claim 9, wherein a longitudinal axis of the rod extends substantially parallel to the inclined side of the carrier block and the inclined side of the restrictor block.

11. The turbine assembly as in claim 9, wherein the carrier plate, the carrier block, the restrictor block and the rod travel together when the lock plate is rotated.

12. The turbine assembly as in claim 9, wherein the support assembly further comprises a bushing for coupling the support assembly to the outer turbine casing, wherein the rod extends through the bushing.

13. The turbine assembly as in claim 12, wherein the rod is configured to slide with respect to the bushing as the lock plate is rotated.

14. The turbine assembly as in claim 9, wherein the inner turbine casing further includes a support arm that extends radially outward from the inner turbine casing between the carrier block and the restrictor block, wherein a support surface of the support arm is engaged with a carrier side of the carrier block.

15. The turbine assembly as in claim 14, further comprising a clearance gap defined between the support arm and a restrictor side of the restrictor block.

16. The turbine assembly as in claim 14, further comprising a wear surface defined between the carrier side of the carrier block and the support surface of the support arm, wherein the wear surface is defined by at least one of a shim and a coating disposed along at least a portion of the carrier side.

17. The turbine assembly as in claim 9, further comprising one or more bearings to facilitate relative movement between the support assembly and the outer turbine casing.

18. A method for adjusting an inner turbine casing with respect to an outer turbine casing, comprising:

providing an inner turbine casing including a support arm that includes a support surface;

providing an outer turbine casing including an aperture defined therethrough, wherein the outer turbine casing is radially outward from the inner turbine casing, wherein the outer turbine casing includes a lower shelf having an inclined surface and an upper shelf having an inclined surface; and rotating a lock plate that is threadably connected to a rod of a support assembly coupled to the outer casing to simultaneously move a carrier plate, a carrier block that is slideably engaged with the inclined surface of the lower shelf and a restrictor block that is slideably engaged with the inclined surface of the restrictor block, wherein the rod extends through the aperture defined in the outer turbine casing and wherein the carrier block supports the support arm of the inner turbine casing.

19. The method as in claim 18, further comprising rotating the lock plate about the rod to cause the carrier block to slide along the lower shelf and the restrictor block to slide along the upper shelf simultaneously to adjust a vertical position of the inner turbine casing with respect to the outer turbine casing.

20. The method as in claim 19, wherein rotating the lock plate about the rod in a first rotational direction raises the inner turbine casing with respect to the outer turbine casing and rotating the lock plate about the rod in a second rotational direction lowers the inner turbine casing with respect to the outer turbine casing.

* * * * *